US009309688B2

(12) United States Patent
Bergman

(10) Patent No.: US 9,309,688 B2
(45) Date of Patent: Apr. 12, 2016

(54) STRUCTURAL POST AND BEAM CONNECTION DEVICE WITH FRICTION RELEASE BRACKET

(71) Applicant: Richard Bergman, Ottawa (CA)

(72) Inventor: Richard Bergman, Ottawa (CA)

( * ) Notice: Subject to any disclaimer, the term of this patent is extended or adjusted under 35 U.S.C. 154(b) by 0 days.

(21) Appl. No.: 14/636,111

(22) Filed: Mar. 2, 2015

(65) Prior Publication Data

US 2015/0247336 A1 Sep. 3, 2015

Related U.S. Application Data

(60) Provisional application No. 61/946,136, filed on Feb. 28, 2014.

(51) Int. Cl.

| | |
|---|---|
| ***E02D 5/74*** | (2006.01) |
| ***E04H 12/22*** | (2006.01) |
| ***E02D 27/42*** | (2006.01) |

(52) U.S. Cl.

CPC ..... *E04H 12/2223* (2013.01); *E02D 27/42* (2013.01); *E04H 12/2261* (2013.01); *E04H 12/2284* (2013.01); *E02D 2200/115* (2013.01); *E02D 2600/30* (2013.01)

(58) Field of Classification Search

CPC . E04H 12/2215; E04H 12/2269; E04H 12/22; E04H 12/2223; E04H 12/2261; E04H 12/2284; E02D 5/801; E02D 5/80; E02D 27/42; E02D 2600/30; E02D 2200/115; A01K 97/10

USPC ..... 52/157, 298, 165; 248/156, 545, 534, 248/530; 411/222

See application file for complete search history.

(56) References Cited

U.S. PATENT DOCUMENTS

| | | | | |
|---|---|---|---|---|
| 2,652,999 | A * | 9/1953 | Lohmar | 248/530 |
| 4,863,137 | A * | 9/1989 | Cockman et al. | 248/545 |
| 5,123,623 | A * | 6/1992 | McNamara | 248/545 |
| 5,456,441 | A * | 10/1995 | Callies | 248/521 |
| 6,272,798 | B1 * | 8/2001 | Cockman | 52/155 |
| 6,334,281 | B1 * | 1/2002 | Oliver et al. | 52/157 |
| 6,871,455 | B1 * | 3/2005 | Cockman et al. | 52/165 |
| 7,137,228 | B2 * | 11/2006 | Wagner | 52/295 |
| 8,082,702 | B2 * | 12/2011 | Hill | 52/155 |
| 8,322,678 | B2 * | 12/2012 | Zhu et al. | 248/530 |
| 2006/0060749 | A1 * | 3/2006 | Dahlstrom | 248/545 |
| 2014/0020310 | A1 * | 1/2014 | Lee | 52/157 |

* cited by examiner

*Primary Examiner* — Beth Stephan

(57) ABSTRACT

A post anchoring support device comprising a ground anchor having a shaft with a threaded upper portion terminating in an upper end that may be engaged and rotated by a drive tool for rotating the shaft about a vertical axis, and a lower portion for insertion into the ground, and a post receiving bracket having base with a vertically oriented internally threaded portion adapted to receive the externally threaded portion of the shaft, a support portion defining a support surface for abutting the end of the post, vertical planar walls extending above the support surface, each planar wall having an inside surface for abutting a side of the post, and each planar wall defining a plurality of vertically oriented elongate holes and having a raised portion on the outside surface adjacent each elongate hole adapted to abut a lower surface of a head of a fastener passing through the elongate hole and into the post to allow the fastener to travel within the elongate hole upon the application of a vertically force to the post anchoring support device sufficient to overcome a coefficient of friction between the head of the fastener and the raised portion.

10 Claims, 6 Drawing Sheets

STRUCTURAL POST AND BEAM CONNECTION DEVICE WITH FRICTION RELEASE BRACKET

BACKGROUND OF THE INVENTION

1. Field of the Invention

The present invention relates to devices and methods of support structures for decks, sheds and similar small buildings that are not connected to a frost and heave resistant superstructure, in particular structural post and beam connection devices and methods having a friction release mechanism.

2. Description of the Related Art

Decks and other structures that are supported in the manner to be explained are known in the art as "floating" in the sense that they rest on the surface of the grade and are free to move up or down as the soil expands or contracts annually as a result of frost or imposing loads on a given footing that exceeds the soil bearing capacity. It is this uncontrollable independent movement of each footing that can cause destructive forces to certain connections in the support structure. Some examples of footings for deck structures include concrete piers buried in the soil, helical piers screwed into the ground, or ground spikes impaled into the ground. A problem arises, however, when the bottoms of posts of the deck or structure are rigidly attached to the footings, such as for example via an intermediary post bracket that has a lower appendage embedded into the footing material, usually concrete, and the top ends of posts are securely attached to the underside of beams of the overlying construction by toe-nail screwing methods or metal structural connectors. This is a practical and common way to build a support structure for a floating deck, and in so doing a system is created comprising three elements; the footing and its relative holding power in the soil, the post bracket connecting to the post, and the post connecting to the beam. The connection points between each of these three elements are not designed to have any flexibility when the system is under load or stress in the field. So long as any movement upward or downward in the soil is imposed equally on each footing under each beam that supports the deck or similar construction, the forces imposed on the connection points will be in balance and no connection will be under more or less stress than another. In such a state, there is little if any risk that any of the connection points within the system will break.

As used herein, a frost resistant footing means a pier buried in the soil or support device the underside of which is located below the frost line in the soil. The alternative is a non-frost resistant footing which is located within the frost zone or directly on the surface of the soil. What often occurs in the field with non-frost resistant footings among the prior art is that the connections are put under stress when asymmetrical forces are generated as a result of variable freezing in the soil or variable soil bearing capacity from one footing to the next in a plurality of footings under a single beam.

Thus the forces imposed on any given footing and its elements, as defined earlier, are unequal. This is because each connection among the three elements in the prior art systems is rigid and intentionally designed not to move or flex. The prior art system will hold until the force imposed on any connection surpasses its load capacity, and when this occurs, the weakest link or connection in the system will give way and break. Examples of this would be post to beam connections separating to relieve and balance the stress in the system. Or screws in the post bracket that secure the post may shear in order that the post may lift up out of the post bracket to relieve the stress. Or if none of these connections fail, the footing may be pulled up from the soil. Any of these scenarios is not desirable since the integrity of the structure will have been compromised. The only way to entirely avoid this destructive scenario is to forego the simplicity and cost savings of a floating deck and install frost resistant footings; be they concrete piers with footings extending below the frost line or engineered helical piers which can be screwed in to the ground well below the frost line. In such cases, the deck is no longer floating but rather it is immobile. And because it is immobile, all connection points described above are protected. Such methods require more labor and materials and are considerably more expensive than a floating deck structure. The very desirability of using a floating deck style of construction is to simplify and reduce costs of the construction process. If a floating deck is built using the prior art devices and methods, costs savings and convenience of installation are enjoyed, but the critical connections described that form the support structure system are at risk of failing due to uneven forces acting on the various support connections.

An example of a prior art support system that is not vulnerable to the uneven force issue is taught by Hoffman in U.S. Pat. Nos. 5,392,575, 5,953,874 and 6,609,346. The systems therein do not cause connections to break as described above, but neither do they provide a secure connection between the ground and the support posts. This system comprises a concrete block, sometimes referred in the art as "deck blocks". These are simple in design and concept and are shaped like a pyramid but with a flat top, wherein there are cavities formed within the top surface in order to fit a post or joist. If one block is lifted by frost and another is not, the post under the beam above the block that did not rise would simply lift up out of the cavity in the block. This ensures no connection is ever broken, but the entire structure is only held in place by its own weight. However, many jurisdictions prohibit the use of such blocks because high winds (for example as in tornado or hurricane situations) may lift the entire deck or may pick up and toss the blocks. Hence, while concrete blocks as taught by Hoffman address one aspect of the problem at hand, they leave structures vulnerable in other ways.

In the field of construction for outdoor structures such as decks, sheds, stair landings and the like, a number of alternatives to traditional concrete piers and large surface area footings (dug into the soil and set so that the underside of said footing is below frost depth) have been developed. These devices have been developed in an effort to avoid the labor and expense of digging holes either for securing posts to the ground for fencing or for supporting structures and bearing weight. The field of prior art devices for post brackets, post spike devices and the like is crowded, therefore it may be helpful to review the progression of the development of the various devices over the last century in order to understand the problems that each device was intended to address. By observing the steady and constant advancement it will be clear to see where the various groupings of devices have headed and also expose new problems that have arisen in different segments of the art and which remain to be adequately solved.

The prior art devices that became the precursors to some of the common structural connectors we now see in the field of wood construction is exemplified by Yeager in U.S. Pat. No. 1,699,557, which resembled an H shape whereby two opposing boards could be connected and firmly held in place within the H shaped vertical and opposing flanges. Small apertures were defined on the flanges to permit nails or screws to be driven perpendicularly through the flange and into the wood board to lock it in place. The boards so joined were not intended to ever move again. A similar device is taught by Krabiel in U.S. Pat. No. 1,816,226, which also shows similar physical characteristics to Yeager but in the form of a U shaped connector. Apertures are defined in the flat surface of the U shaped rather than the vertical and opposite flanges which permit nails or screws to be guided as they are driven into a wooden member. The vertical flanges are then embedded into wet cement and left to cure in place. Bierbach in U.S. Pat. No. 2,191,979 advanced the concept taught in Yeager by introducing various curves and formed convex shapes to the metal. Legs with embossments are present and used to provide better holding power once set into wet cement. A beam is set into the upper vertical flanges and small apertures in these flanges are provided to guide any nails or screws used to secure the beam in the device. In 1973, Howell in U.S. Pat. No. 3,727,358 added to this genre of metal connector by virtue of its unique folding method of manufacture and its ability to compensate for sloped surfaces while orienting a post vertical relative to its surroundings. Common to the Howell device are the numerous apertures for nails or screws locking the post in place and rendering it immobile. In U.S. Pat. No. 4,906,677, Gib teaches a further manufacturing refinement using a single sheet of steel and configured so that two looping appendages could be set into wet cement while providing a stand off base to keep the wood post elevated above the concrete surface and upstanding legs or flanges to encapsulate and hold the post secure with bolts. The post is intended to remain immobile once secured within the anchoring bracket. Structures using this method of anchoring are intended to be stable and immobile by virtue of the concrete footing that the structure rests upon also intended to be immobile.

Further examples of similar style post holder brackets include devices taught by Han in U.S. Pat. No. 4,958,470, Colonias in U.S. Pat. No. 4,995,206, Reed in U.S. Pat. No. 5,143,472 and Leek in U.S. Pat. No. 5,333,435. There are aspects to each device which vary from the other and these tend to be in the way the metal is shaped and bent. But among them all, it is clear to see that they all have very similar upstanding legs or flanges between which a post is cradled and precise circular apertures through which fasteners are aligned and driven into the wood post to lock it in place permanently.

The permanency of the fitting is intended to address the use of the device in the field. All of these solutions are themselves secured permanently to an immobile substrate or footing of concrete. Mobility of the underlying concrete footing is not intended nor is it desirable for the building applications these devices are designed to be used in.

Continuing with a review of the prior art we now move in a slightly different direction where we see a myriad of devices designed to make the installation of fence posts easier and simpler by employing spikes or helixes impaled or screwed into the ground with post brackets on the upper remote end of the device resembling the similar physical features of the earlier prior art discussed. Mills in U.S. Pat. No. 4,588,157 and Brown in U.S. Pat. No. 5,090,656 both employ inwardly directed tangs specifically formed to permit slicing into the material of the post bottom being urged into the cavity of the post bracket. The tangs are intended to secure the post more effectively than screws alone as well as secure posts which may be undersized relative to the post bracket cavity. However, consistent with the prior art, circular apertures are defined in the upper walls of the post bracket for screws or nails to be driven and permanently secure and render the post immobile. Idland in U.S. Pat. No. 4,614,070 uses a means of adjusting the width between the upstanding legs or flanges of the post bracket to adjust to the variance in width from one post to another within a defined range of post sizes. It too uses circular apertures for screws to pass through and permanently affix or lock the post into the post bracket. Meyer (U.S. Pat. No. 6,273,390), Speece (U.S. Pat. No. 5,927,577) and Walker (U.S. Pat. No. 7,219,872) developed post support solutions for driving fence posts into the ground. While all of these devices function as a post ground spike, they all attempt to make it easier to finely adjust the vertical attitude of the post in situations where the spike can not be driven perfectly perpendicular into the ground or if the spike is installed on a slope. They employ various styles of ball joint connections between the lower spike and upper post bracket portion of their respective devices. Common among these three devices is the known prior art post bracket styles of a defined inner cavity with an open portion with flanges at one corner of the defined cavity that can be clamped together thus compressing the cavity walls around the post. Circular apertures are defined in the cavity walls to align screws or nails which may be driven into the post and permanently locking it in place. Opposing flanges at an open corner of the post bracket are also found in the Zhu device (U.S. Pat. No. 8,322,678) although the main advancement with the Zhu device is the concept of using thinner sheet metal for the lower spike appendages and adding stamped and embossed reinforcement lines shapes running along the longitudinal axis of the spike so as to render the thinner metal more rigid.

Other devices which go further in trying to create one size of post support bracket that may fit tighter with a greater range of post sizes are the Hill device (U.S. Pat. No. 7,730,675) and the Callies device (U.S. Patent Publication No. 2005/0279896). Both teach a device whereby impressions are embossed into the vertically defined walls inside of the bracket which hold the post. These impressions protrude inwardly into the cavity of the post bracket from the inside planar surfaces defining the cavity. One variant device from this grouping of prior art devices is the Teeters device (U.S. Pat. No. 4,199,908) which employs an elongated aperture running horizontally so that the post supporting portion of the device may be easily moved horizontally and then affixed at the desired location by nuts and bolts. Vertically opposing and upstanding legs then fit snuggly against the post. Screws or nails may be driven through circular apertures and into the post locking the post permanently in this position. The elongated apertures address the desire of users to have a degree of horizontal motion while determining the final position of the post. But once that final location is found, the post is intended to be precisely but permanently secured in position.

A further nuance among the ground anchor genre of devices is the Boulay device (U.S. Patent Publication No. 2011/0036025). Boulay teaches the use of a helical anchor common among the prior art but with a cap plate with a central circular aperture through which the top threaded remote upper end of the anchor protrudes. The underside of the cap plate rests on the upper surface of an ring integrally formed around upper shaft of the helical anchor rod just below where the threads terminate. The cap plate is compressed against the ring but with two nuts having differing outer diameters above it. A conventional post bracket similar to the prior art devices can be screwed on to the remote end of the threaded rod if a similar threaded female nut or aperture is located underside of the post bracket. Additionally, any other kind of attachment could be screwed onto the threaded rod such as a loop shaped device enabling the device to function as an anchor for guy wires and the like. The claimed unique characteristics of the Boulay device are the two different size nuts which are used to screw tightly together. Once locked together and so long as the fit is very tight with the threads on the rod and the nuts, different sizes of sockets can be fitted over either the larger lower nut or smaller upper nut and drive the anchor downward or upward from the soil. However, the proficiency and reliability of using two nuts to screw tightly against one another along a common inner threaded rod that defines a longitudinal rod with helical blades to screw into the ground and such that the resulting union of the two nuts functions as a fixed point along the rod critically allowing the entire rod to turn forward or reverse is proven to be low. All elements of the union of the nuts, the threads and the rod must function perfectly for the rod to screw down or into the ground and if any element fails such as the nuts turning in unison or in synchronization with each other around the threaded rod or the threads of a single nut or along the rod are stripped, the rod will no longer be capable of being rotated under the driving torque forces of the impact wrench rendering it useless in the field. It has been discovered that the only reliable structure for driving or rotating an anchor such as in Boulay into the ground is to incorporate a direct drive structure integral to the rod itself, such as a square, hexagonal or similar as in the present invention as described and illustrated herein. Lastly, Boulay does not address the problem of uneven vertical movement caused by ground movements, and it does not teach or suggest any structural features in post receiving bracket of his device that would permit the post to move vertically if subjected to soil movement and pressures generated from other natural movement or subsidence. Structures built with the Boulay device would have no means to safely release such energy, and leave at risk any of the critical elements of both the device and the structure that is supports for the possibility of breaking.

The concept of a helical anchor as a ground anchor was also used by Alexander (U.S. Pat. No. 4,803,812) and Cockman (U.S. Pat. No. 4,863,137). Alexander taught the use of a helical anchoring device that could be easily driven into the ground using power tools rather than heavy equipment. A horizontal plate for stabilization or load bearing is integral to the device, not unlike the Boulay device. A prop or vertically oriented tube or solid cylindrical member protrudes upward from a second horizontal platform also integral to the anchoring rod. It is intended for hollow metal posts or wood posts with hollowed cores to be fitted over the prop and thus secured in place. While such a device and method provides a desirable means of attaching posts to the ground with greater ease than the prior art at the time, Alexander does not touch upon the problem of uneven soil movement nor how this device would alleviate the risks of post and beam connections failing were the device to used among a plurality of said devices under a common beam intended to support compressive loads upon soil subject to frost or other natural movements or subsidence. Cockman proposed using a helical anchoring rod similar to the prior art but taught the use of a compression disk integral to the upper remote end of the rod and the use of a post bracket using the common vertical side panels but with the ability to slide in an outward to accommodate varying sizes of posts. The compression disk was intended to compress soil downward after it had been churned by the turning helical blades. The post bracket uses similar design and function attributes seen among the entire prior art. That is to say, opposing vertical flanges between which a post is placed and numerous circular apertures through which screws or nails can be driven through and securing the post into the bracket. The post is permanently secured and the entire anchor and post are intended to never release from one another. Likewise Cockman did not address the issue of soil movement and uneven forces created in system of ground anchored posts. Such forces are known to destroy post and beam connections when footings under a common beam are subject to differing movements.

In 2009, Hill (U.S. Patent Publication No. 2009/0133337) proposed an adaptation to the his earlier device (U.S. Pat. No. 7,730,675). This adaptation utilized a load bearing plate through which the cross shaped fins of the ground spike could fit through. Hill teaches to drive the ground spike into the ground using a sledge or jackhammer thereby compressing the soil underneath the load bearing plate. The larger surface area of the bearing plate spreads the weight of any structure above it over a larger area than if the post anchor spike were used without the plate. As discussed previously, the upper post bracket portion of the device employs inwardly embossed zones to compensate for a known variance in post size and circular apertures through which screws are driven and permanently locking the post into place. The Hill device is a means of installing load bearing posts when the load bearing plate is used. However the Hill device lacks the ability for any single post among a plurality of posts supporting a common beam to release by virtue of a friction triggered method or any other method which would relieve uneven stresses built up in the post, beam and footing system caused by uneven soil movement. As a result decks or other structures using this system in areas where frost of uneven soil bearing capacity exists are subject to the risks of destruction discussed herein.

Although there have been devices and methods taught over nearly a century in the field of ground driven post anchoring means, none of the prior art teaches or contemplates a solution for the problem of uneven soil movement and a simple and effective means of protecting the integrity of the post and beam connections among a plurality of support posts under a common beam. The original use for these devices and their adaptations particularly the ground spikes and helical anchors, was most commonly intended for single fence posts or single ground anchors. However, because of the continued desire to find easier and less expensive means of building footings and foundations for lightweight structures, the use of these prior art devices in situations such as support posts under common beams began to expose their limitations.

Accordingly, there is a need for devices and methods of support structures for decks, sheds, small buildings and similar light weight constructions that are capable of compensating for asymmetrical uplift forces acting on any single footing within a plurality of footings under a common beam such as may occur, for example, due to differing frost conditions in the soil or variable soil bearing capacity.

SUMMARY OF THE INVENTION

In order to address some of the shortcomings in the prior art, some aspects of the present invention provide a post anchoring support device for anchoring an end of a support post of a deck or similar construction to the ground, the post anchoring support device comprising: a ground anchor having a shaft with a lower portion and an upper portion, the upper portion having an externally threaded portion and terminating in an upper end having at least one planar vertical wall for enabling the upper end to being engaged and rotated by a drive tool for rotating the shaft about a vertical axis, the lower portion having a lower end for insertion into the ground and at least one helical blade circumscribing the shaft above the lower end for boring the lower portion into the ground as the shaft is rotated about the vertical axis; and a post receiving bracket having base with a vertically oriented internally threaded portion adapted to receive the externally threaded portion of the shaft, a support portion defining a support surface for abutting the end of the post, the support surface being located vertically on the receiving bracket to be above the upper end of the shaft when the internally threaded portion is mated to the external threaded portion, at least two vertical planar walls extending above the support surface, each planar wall having an inside surface for abutting a vertical side of the post and an outside surface, and each planar wall defining a plurality of vertically oriented elongate holes and having a raised portion on the outside surface adjacent each elongate hole adapted to abut a lower surface of a head of a fastener passing through the elongate hole and into the post to allow the fastener to travel within the elongate hole upon the application of a vertically force to the post anchoring support device sufficient to overcome a coefficient of friction between the head of the fastener and the raised portion.

In some embodiments, the post anchoring support device may further comprise a horizontal plate member adapted to being received about the shaft of the ground anchor, sandwiched between the ground and the base of the post receiving bracket when the ground anchor has been driven into the ground and the internally threaded portion of the post receiving bracket is mated to the external threaded portion of the ground anchor. In some embodiments, a second hole may be provided on the horizontal plate dimensioned to accommodate the shaft, a circumferential platform on the upper portion of the shaft below the externally threaded portion for abutting a bottom surface of the horizontal plate about the second hole, and a nut complementary to the externally threaded portion for engaging an upper surface of the horizontal plate about the second hole and securing the horizontal plate against the circumferential platform.

In some embodiments, the support portion may comprise comprises a first and second horizontal platforms and a recessed platform in between the first and second horizontal platforms, the recessed platform defining a third hole dimensioned to accommodate the shaft, and the internally threaded portion is connected to the recessed platform coaxially with the third hole, wherein the recessed platform is positioned below the first and second horizontal platforms by a distance sufficient to provide clearance between the upper end of the shaft and first and second horizontal platforms when the internally threaded portion of the post receiving bracket is mated to the external threaded portion of the ground anchor.

In some embodiments, each raised portion may comprise a narrow edge portion of highest elevation adjacent the elongate hole for abutting the lower surface of the head of the fastener, and tapers in elevation away from the elongate hole.

In some embodiments, a post anchoring support device for anchoring an end of a support post of a deck or similar construction to the ground is provided comprising: a ground anchor having a shaft with a lower portion and an upper portion, the upper portion having an externally threaded portion and terminating in an upper end, the lower portion having a pointed lower end for facilitating insertion into the ground as the ground anchor is driven into the ground; and a post receiving bracket having base with a vertically oriented internally threaded portion adapted to receive the externally threaded portion of the shaft, a support portion defining a support surface for abutting the end of the post, the support surface being located vertically on the receiving bracket to be above the upper end of the shaft when the internally threaded portion is mated to the external threaded portion, at least two vertical planar walls extending above the support surface, each planar wall having an inside surface for abutting a vertical side of the post and an outside surface, and each planar wall defining a plurality of vertically oriented elongate holes and having a raised portion on the outside surface adjacent each elongate hole adapted to abut a lower surface of a head of a fastener passing through the elongate hole and into the post to allow the fastener to travel within the elongate hole upon the application of a vertically force to the post anchoring support device sufficient to overcome a coefficient of friction between the head of the fastener and the raised portion. Each raised portion may comprise a narrow edge portion of highest elevation adjacent the elongate hole for abutting the lower surface of the head of the fastener, and tapers in elevation away from the elongate hole.

The devices and methods of the present invention compensate for a degree of asymmetrical uplift forces on any single footing within a plurality of footings under a common beam resulting from differing frost conditions in the soil or variable soil bearing capacity. Such differences can occur due to differing moisture retention in the soil proximate to each footing. Moisture retention in soil may differ based on its permeability or lack thereof. The present invention relates to attributes of a post bracket or "saddle bracket" as they are also known, or similar style post connector that when affixed to the end of a post, said post may slide up and down within the saddle bracket, without resulting in structural failure, as compared with prior art brackets which offer no means for such release and movement. For example, when one or more footings under a common beam is lifted upwards by soil expansion caused by freezing, said footing in turn pushes the beam upwards generating tension forces among the other post to beam connections (whose footings are stationary relative to the first footing described) and when one or more of these other footings under the common beam are not subjected to the same uplifting forces thereby remaining stationary, the post connected to the post bracket in the stationary footing may release and slide up in the post bracket, relieving the stress and preserving its connection with the beam above it. It also preserves the footing connection in the soil and alleviates any upward pulling force from the soil that would have existed if the other two connection points in the system did not fail and relieve the stress.

An embodiment of the invention comprises a ground anchor, a load distribution plate and a post receiving bracket. In this embodiment the ground anchor, load distribution plate and post bracket are separate pieces which assemble together during installation to provide a device from which the stated benefits and heretofore unavailable advantages are derived. In an embodiment the ground anchor comprises an auger rod with at least one helical blade at the lower terminus. The load distribution plate has an aperture in its center through which the rod may pass through. At the upper terminus the rod has a hex shaped head to be received in a socket, a threaded portion below the hex head and an embossed ring or stop washer like shape protruding outwards perpendicularly from the longitudinal axis of the rod such that the load distribution plate may rest upon the embossed ring or stop washer. The post bracket has a female threaded region in the form of a nut or other similar formation defined in the underside of the post bracket into with the upper threaded terminus of the rod can be threaded into for all three parts to mate securely together. In an embodiment the post bracket has at least two vertical upstanding flanges whose inner surfaces are opposite each other and allow a post to fit between. The flanges have defined in them elongated holes vertically aligned parallel to the vertical axis of the flanges and an embossed region around the perimeter of the holes. The embossed area rises outward from the outside surface of the flanges. Furthermore, the elongated holes are offset from each other on the surface of the flange in a staggered fashion, one lower and the other higher with respect to each other. These three structures may be installed together and connected to the underside of a common carrier beam by posts secured into each post bracket.

BRIEF DESCRIPTION OF DRAWINGS

For a better understanding of the present invention and to show more clearly how it may be carried into effect, reference is made by way of example to the accompanying drawings in which.

DETAILED DESCRIPTION

Figure 1:
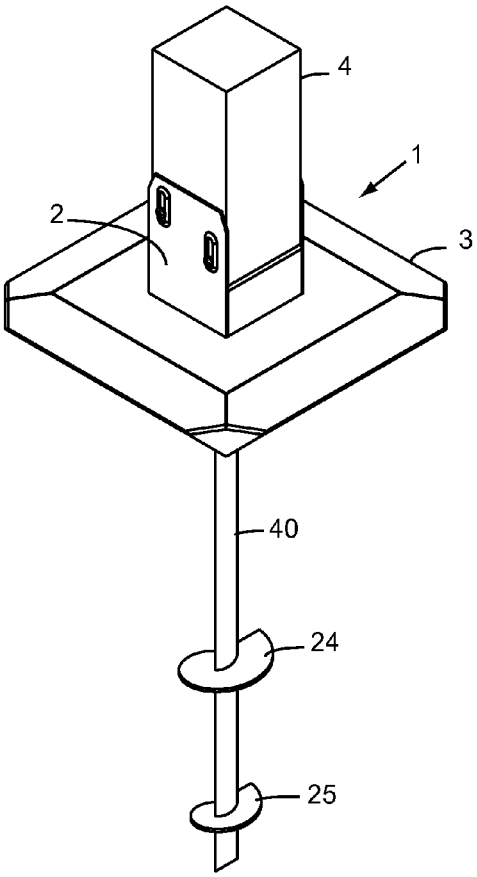
FIG. 1 is a perspective view of the complete device of one embodiment including a ground anchoring auger rod, load plate and post bracket.

For the purposes of promoting an understanding of the principles of the invention, reference will now be made to the exemplary embodiments illustrated in the drawings, and specific language will be used to describe the same. It will nevertheless be understood that no limitation of the scope of the invention is thereby intended. Any alterations and further modifications of the inventive features herein, and any additional applications of the principles of the invention as illustrated herein, which would occur to one skilled in the relevant art and having possession of this disclosure, are to be considered within the scope of the invention.

Referring to FIGS. 1-10, there is depicted an embodiment of post anchoring support device 1 in accordance with the present invention. The post anchoring support device comprises a post receiving bracket 2 that permits placement of a post 4 set inside the inner cavity of said device, said cavity defined by at least two opposing and upwardly standing walls or flanges 5 rising from a base and first common horizontal planar surface 6 which said post 4 would rest downward upon, to be connected to the upward flanges 5 by screws 10 passing through vertical aligned and elongated holes 8 of the flanges, said flanges are further defined by a raised portion or embossed region 9 circumscribing the elongate holes 8 in an upwardly sloping direction and away from the outside planar surface 11 of the flange such that when a screw 10 is driven into the post the underside of the screw head rests at the first point of surface contact with the elevated or embossed edges of the holes; said embossed surface slopes from its highest elevation downwards toward the greater planar surface 11 of the flange at an approximate 45 degree angle so as to direct the compression force of the screw as far away from the penetration point and over as large a surface area as possible.

Figure 7:
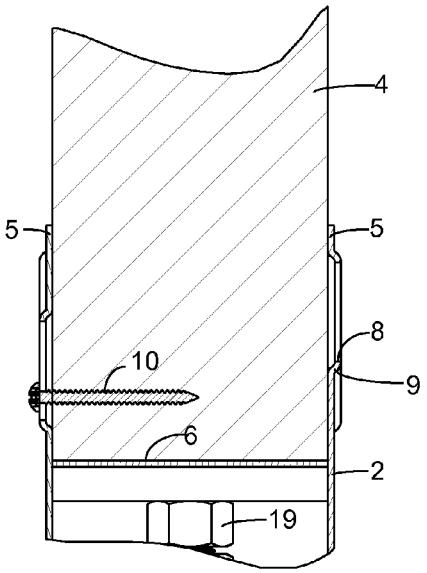
FIG. 7 is a cross sectional view of the post receiving bracket with a post secured by a screw where the post is fully seated and the screw is set in the lowest position in the elongated aperture.
Figure 8:
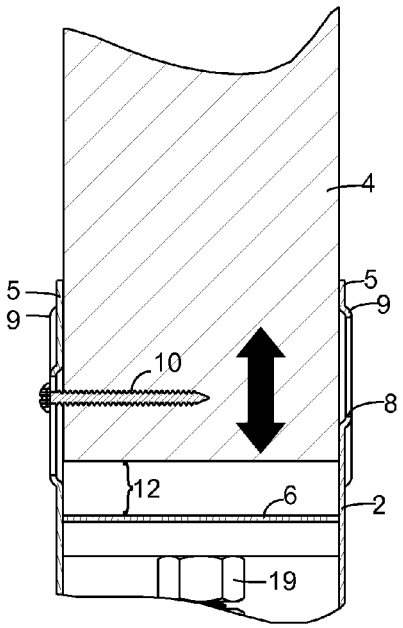
FIG. 8 is another side view cross sectional view of the post receiving bracket with a post secured by a screw where the post is risen within the bracket as would occur with upward forces from the attached beam and the screw has moved upward along the elongated aperture permitting post movement.

FIGS. 7, 8 show the elongated embossed regions 9 circumscribing the holes 8 that dissipate the otherwise highly concentrated compression force of the screw 10 thus reducing the compression force of the flanges 5 and screws 10 against the post 4 which in turn reduces the coefficient of friction and results in a lower force applied to initiate vertical movement of the post against the inner flange surfaces. This allows the post and flanges to slide against each other as the post is pulled up or pushed back down within the flanges when used in conjunction with three or more devices and posts secured to the underside of a common carrier beam in situ and anchored to frost prone soil; said soil possessing differing moisture content from one zone of soil below any given device and the next and thus subject to differing degrees of soil expansion and contraction when water is frozen in the soil and later thaws.

Figure 9:
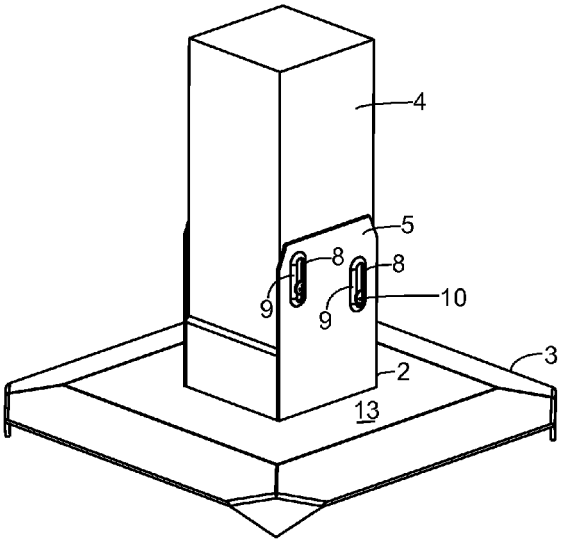
FIG. 9 is a perspective view of the device when installed on the ground and with the post in its lowest flush position.
Figure 10:
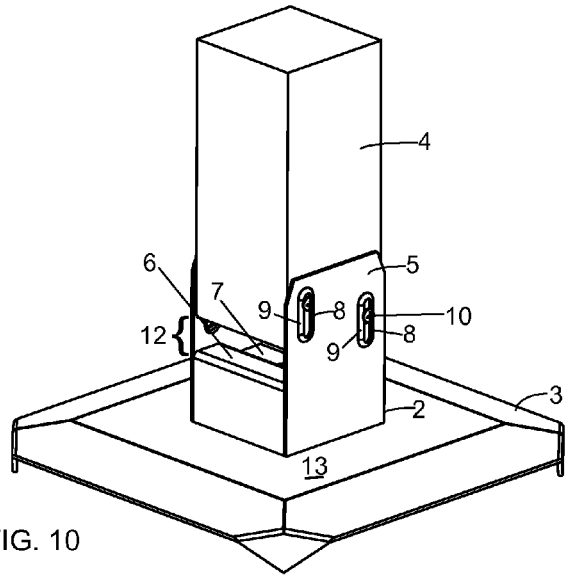
FIG. 10 is a perspective view of the device when installed on the ground and with the post in its highest position.

FIGS. 9, 10 show perspective views of the post 4 and the assembled device 1 of the present invention as it would appear when installed on the ground. FIG. 10 further depicts when soil movement occurs and the post movement is restricted to vertical movement only, creating a space 12 underneath the post within the range that the screws 10 may freely move and defined by the length of the elongate holes 8 and to slide back downward if certain discreet downward forces are subsequently exerted on the post.

Referring again to FIGS. 4-6, in some embodiments the post receiving bracket 2 include a first flat planar surface 6 upon which the bottom of the post may rest and a second planar surface 7 parallel to the first surface but lower such that a cavity 26 is created when the post 4 is fully seated on the first surface 6, said cavity is intended to allow for the hex head 28 upper terminus of the auger rod 40 to pass through aperture 29 defined in surface 7 and through first threaded upper nut 19 welded to underside 30 of upper surface 7 into which a threaded rod with corresponding male threads may be secured.

Figure 2:
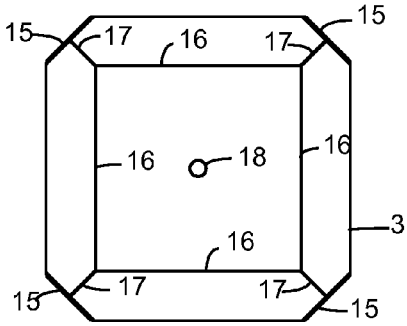
FIG. 2 is a top down view of the load plate showing the center aperture and the folded corner and sides of the plate generally defining a convex upper surface.
Figure 6:
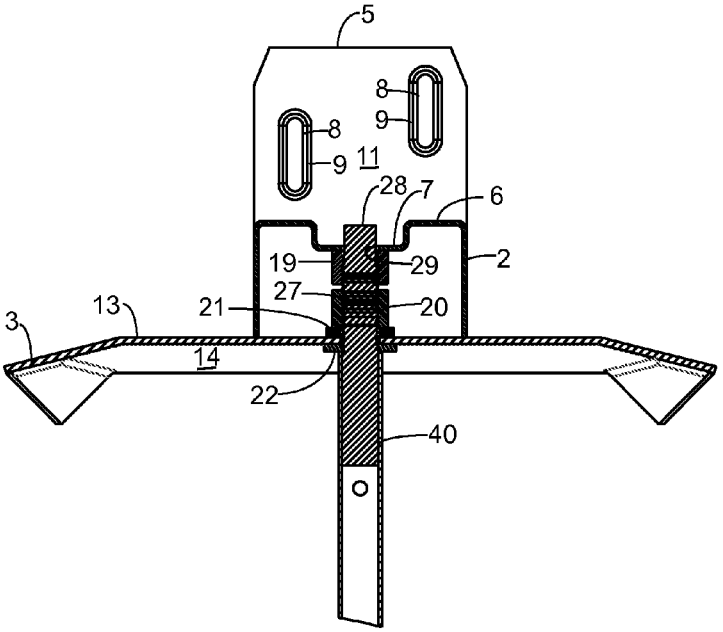
FIG. 6 is a cross sectional view of the ground anchoring auger rod with load distribution plate and the post receiving bracket.

Post anchoring support device 1 as shown in FIGS. 2 and 6 comprises a load plate 3 with an upper surface 13 and an underside surface 14, said load plate featuring bending lines 16 and 17 upon the upper surface 13 such that a convex upper surface is defined or a concave underside surface 14 with corners 15 bent at less than perpendicular from the upper surface 13. An aperture 18 is located in the center of the load plate 3 of sufficient diameter as to allow the threaded rod 27 to clear and pass through such that the plate is free to rotate independently of the auger rod 40.

Figure 3A:
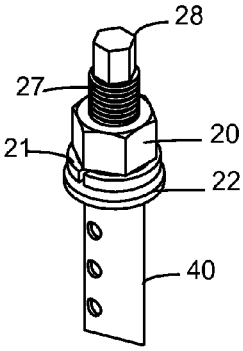
FIG. 3A is a perspective close up view of the threaded rod, nut and hex shaped terminus of the auger rod.
Figure 3:
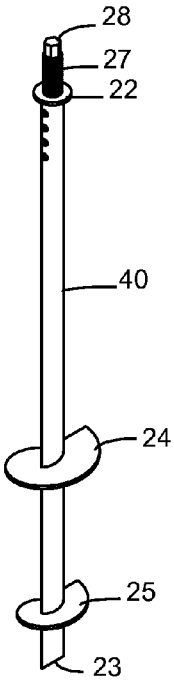
FIG. 3 is a perspective view of the auger rod showing the at least one helix, the stop washer, threaded rod and hex shaped terminus.
Figure 4:
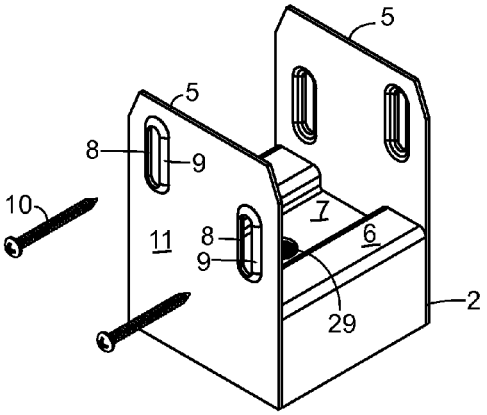
FIG. 4 is a perspective view of the post receiving bracket showing the vertical sides and the vertically elongated fastener holes with outwardly embossed region circumscribing the holes.
Figure 5:
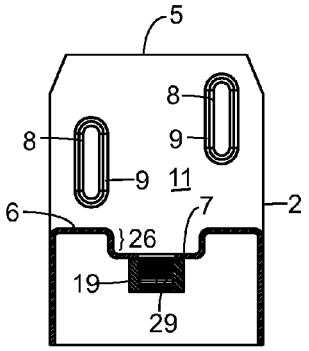
FIG. 5 is a section view of the post bracket showing the vertical side of the bracket and a cross sectional view of the middle.

Post anchoring support device 1 as shown in FIGS. 1, 3 and 3*a* further comprises a cylindrical ground anchoring auger rod 40 preferably made of hollow tubing with stop washer 22, at least one small helix 24 and optional second larger helix 25.

A lock washer 21 and second nut 20 fit over the threaded rod 27 portion, and a lower terminus 23 cut at an angle.

The auger rod 40 further defined by a hexagon portion 28 formed into the upper terminus and beginning after the male threads 27 end, said hexagon portion 28 short enough that its top flat end does not rise above the upper flat planar surface 6 of the post receiving device 2 and conflict with the post bottom when fully threaded into the upper nut 19, said nut welded or formed integrally with the female aperture 29 of second lower planar surface 7.

The rod further defined such that it passes through an aperture 18 in the load plate 3, mating with the upper nut 19 of the post receiving bracket 2, and said bracket possessing a perimeter dimension that is less than the perimeter defined by the load plat 3. The stop washer 22 formed outwardly or transversely from the longitudinal axis of cylindrically shaped rod 40 so that underside of plate 14 can rest on the upper surface of said stop washer 22 while male thread of rod 27 is long enough to mate with the upper nut 19 forming female aperture 29. In this manner, the post receiving bracket device 2, the load plate 3 and the rod 40 can be screwed together until the lower edges of the lower peripheral walls of the device 2 firmly contact the upper planar surface 13 of the plate; the lower terminus of the rod 40 having a helical shape of one or more independent helixes 24, 25 thus permitting the rod to be screwed into the ground by a socket attached to the hexagon shaped upper terminus 28.

In some embodiments rather than helical blades, a spike may be impaled into the ground whereby male threads are similarly defined in an upper remote portion of the spike such that it may thread into a female threaded aperture part as defined in the underside of device 2 so the two may be connected. Such embodiment would differ in its utility as an impalement method of installing the ground anchoring portion would be required demanding greater force to install and require a sledge hammer or jack hammer rather than a simple lightweight pneumatic or electric impact wrench as taught with the preferred embodiment. However, in such an alternate embodiment, the post receiving bracket would function similarly as it would allow or compensate for uneven soil movements among adjacent support posts supporting a common beam by virtue of the unique features of the flanges 7 specifically the elongated holes 8 and the embossed region which spreads the force of the penetrating screws 10 over a larger surface area thus lower the coefficient of friction value at which point the posts may slide vertically and safely within the flanges 11.

Figure 11:
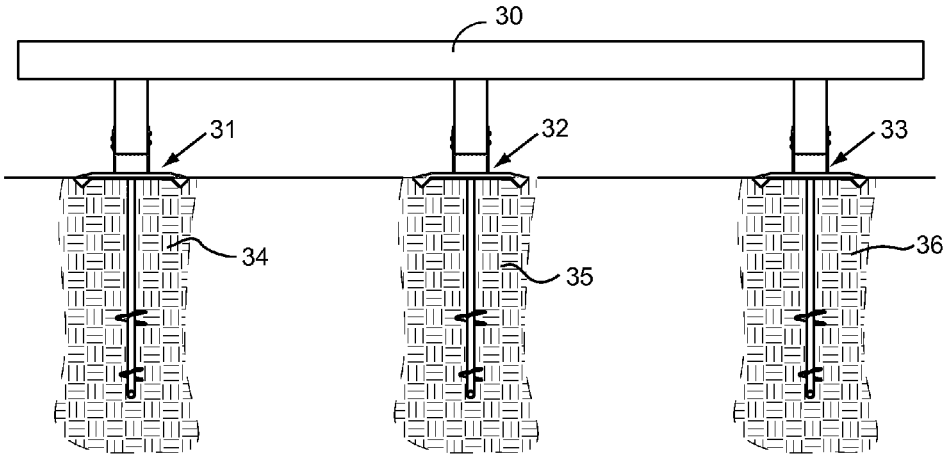
FIG. 11 is a side view of a plurality of devices supporting a common beam and depicts the ground or soil conditions which are disposed to risk of uneven movement or expansion in freezing environmental conditions.
Figure 12:
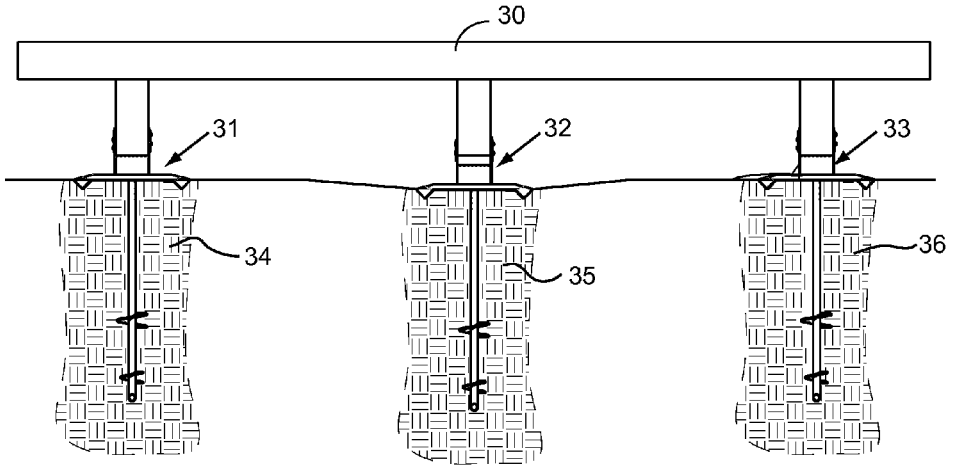
FIG. 12 is another side view of a plurality of devices supporting a common beam and depicts the ground or soil movement during freezing conditions and how the device absorbs uneven forces.
Figure 12A:
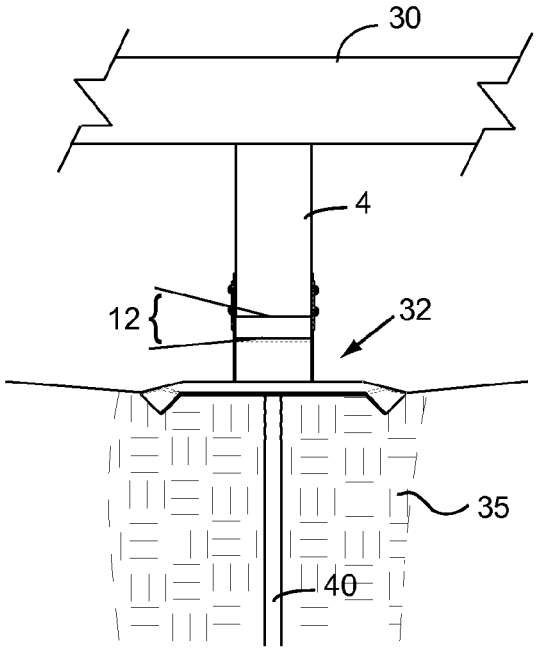
FIG. 12A is a close up side view of the middle device of FIG. 12.

Referring to FIGS. 11, 12 the functionality of the physical features of the completed invention 1 and the method of installation in the field shows how posts and a beam supporting a structure can adjust for uneven soil movements from one footing to the next and thereby protect the post to underside of beam connections from separating. Referring to FIG. 11 a non-freezing environment is depicted or immediately after the devices 31, 32 and 33 have been installed into the ground and the posts and beam 30 have been interconnected. Often unknown to the installer is whether the soil below is homogeneous or heterogeneous. Some soils may differ enough in terms of porosity and within close proximity that is not uncommon in the field to encounter situations where soil zone 34 and 36 are predominantly composed of clay or similar soil such that it retains moisture and where an adjacent soil zone 35 may be of differing composition such that is composed of sand or granular stone such that it does not retain as much or any moisture. If the ground never freezes or is never subjected to any other natural subsidence the positions of the devices relative to one another will not change and the forces exerted on the posts and beam will remain unchanged. However referring to FIG. 12, when freezing conditions occur, the soil zones retaining higher amounts of water will expand upwardly with great force. Devices supporting posts 31 and 33 are pushed upwards in direction A from the frost expansion in soil zones 34 and 36. Posts 31 and 33 in exert upward force on beam 30 causing it to rise and create a tension force on post 32. With all prior art devices, there would be no release mechanism to permit post 32 to move freely upward and preserve the post to beam connection. If the post to post receiving bracket connection were strong enough to resist the tension from the beam connection the post to beam connection would fail. Alternatively if the post to beam connection were strong enough to resist the tension force the buried lower portion of the anchor rod or spike as referred to in alternate embodiments would be pulled up from the soil. This latter scenario is less likely in the instance of a helical blade within the soil if frost surrounds the entire anchor rod in the ground. But this would then result more likely in failure of the post to bracket or post to beam connections. In any of the possible scenarios the entire system is placed under stress and to preserve or protect the system there must be a means of releasing said stress or forces to prevent any damage to the system.

Over the course of seasons a structure built using an embodiment of the present invention in a plurality of connections supporting a common beam will be best designed to absorb and release the powerful and potentially destructive forces generated by most often frost but also any natural subsidence that may occur. The present invention performs this task very efficiently.

In the field a typical installation occurs as follows. An area of soil is prepared by removing and grass (sod) and exposing the soil below. It is preferable to remove and obviously soft or disturbed soil and this is usually achieved by removing three to four inches (8-10 cm) of loose soil. Crushed granular stone is set in place as it tends to be porous and the polygonal shapes of the stone interlock as they compress making them well suited to not erode if heavy rains or water flows over the surface. This soil preparation is done for each area where a device will be located and in common line to support a single beam.

An impact wrench with a socket is then used to drive the helical blades of the rod 40 into the soil in a vertical orientation, perpendicularly to the prepared surface below.

Figure 13:
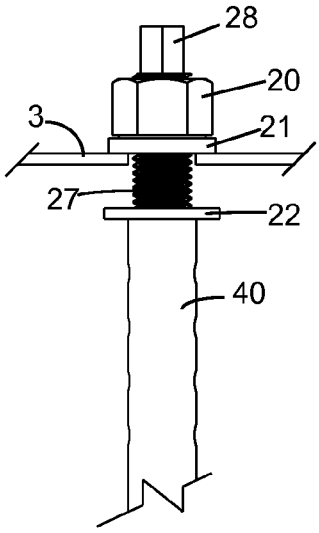
FIG. 13 is a close up side view of the threaded rod, nut and hex shaped terminus of the auger rod shown with a portion of the load distribution plate received on the threaded portion.
Figure 14:
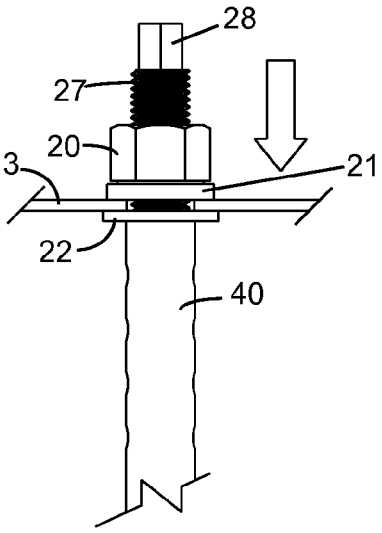
FIG. 14 is a close up side view of the threaded rod, nut and hex shaped terminus of the auger rod shown with a portion of the load distribution plate received on the threaded portion.

Referring to FIGS. 13 and 14 the load plate 3 can be placed over the threaded rod 27 and rest loosely on the stop washer 22. The lock washer 21 would rest loosely on surface 13 of the load plate 3 and the second nut 21 would be turned down on the threaded rod 27 only to the intersection point between the hex head 28 and threads 27 the reasons for which will be explained.

As the impact wrench rotates the helical blades into the ground the load plate 3 is free to remain stationary and not spin wildly in concert with the revolving rod 40. Eventually the underside 14 of the load plate 3 will make contact with the soil and the rod will continue to be driven downwards until the top surface 13 of the load plate contacts the lock washer 21 and in turn the underside of the second nut 21. This state is depicted in FIG. 13.

A larger socket is then placed on the impact wrench and engaged with the second nut 20. The nut is turned downward and forces the load plate 3 to compress the soil below it until the underside 14 contacts the stop washer 22.

The threads of rod 27 now remain exposed and are of sufficient height above the top surface 13 of the load plate as to engage into the threaded aperture 19 of upper nut 20 so that post receiving bracket 2 can be secured with the rod 40 and plate 3 forming the completed device.

Posts 4 are then inserted between the flanges 11 and screwed in place. Tops of said posts are then secured to the underside of the beam 30. In order for the device to function as designed at least three posts must be connected to a common beam, said beam posts and devices them forming a complete system for supporting structures and being capable of absorbing uneven forces from subsidence of the ground.

Although the preferred embodiments of the device and method have been shown in the attached drawings and detailed description, it is understood that the invention is not limited to the embodiments disclosed, but is capable of other modifications without departing from the spirit of the invention set forth and defined in the following claims.

What is claimed is:

1. A post anchoring support device for anchoring an end of a support post of a deck or similar construction to the ground, the post anchoring support device comprising:

a ground anchor having a shaft with a lower portion and an upper portion, the upper portion having an externally threaded portion and terminating in an upper end having at least one planar vertical wall for enabling the upper end to being engaged and rotated by a drive tool for rotating the shaft about a vertical axis, the lower portion having a lower end for insertion into the ground and at least one helical blade circumscribing the shaft above the lower end for boring the lower portion into the ground as the shaft is rotated about the vertical axis; and a post receiving bracket having a base with a vertically oriented internally threaded portion adapted to receive the externally threaded portion of the shaft, a support portion defining a support surface for abutting the end of the post, the support surface being located vertically on the receiving bracket to be above the upper end of the shaft when the internally threaded portion is mated to the external threaded portion, at least two vertical planar walls extending above the support surface, each planar wall having an inside surface for abutting a vertical side of the post and an outside surface, and each planar wall defining a plurality of vertically oriented elongate holes and having a raised portion on the outside surface adjacent each elongate hole adapted to abut a lower surface of a head of a fastener passing through the elongate hole and into the post to allow the fastener to travel within the elongate hole upon the application of a vertical force to the post anchoring support device sufficient to overcome a coefficient of friction between the head of the fastener and the raised portion.

2. The post anchoring support device of claim 1 further comprising a horizontal plate member adapted to being received about the shaft of the ground anchor, sandwiched between the ground and the base of the post receiving bracket when the ground anchor has been driven into the ground and the internally threaded portion of the post receiving bracket is mated to the external threaded portion of the ground anchor.

3. The post anchoring support device of claim 2 further comprising a second hole on the horizontal plate dimensioned to accommodate the shaft, a circumferential platform on the upper portion of the shaft below the externally threaded portion for abutting a bottom surface of the horizontal plate about the second hole, and a nut complementary to the externally threaded portion for engaging an upper surface of the horizontal plate about the second hole and securing the horizontal plate against the circumferential platform.

4. The post anchoring support device of claim 3 wherein the support portion comprises a first and second horizontal platforms and a recessed platform in between the first and second horizontal platforms, the recessed platform defining a third hole dimensioned to accommodate the shaft, and the internally threaded portion is connected to the recessed platform coaxially with the third hole, wherein the recessed platform is positioned below the first and second horizontal platforms by a distance sufficient to provide clearance between the upper end of the shaft and first and second horizontal platforms when the internally threaded portion of the post receiving bracket is mated to the external threaded portion of the ground anchor.

5. The post anchoring support device of claim 1 wherein each raised portion comprises a narrow edge portion of highest elevation adjacent the elongate hole for abutting the lower surface of the head of the fastener, and tapers in elevation away from the elongate hole.

6. The post anchoring support device of claim 5 further comprising a horizontal plate member adapted to being received about the shaft of the ground anchor, sandwiched between the ground and the base of the post receiving bracket when the ground anchor has been driven into the ground and the internally threaded portion of the post receiving bracket is mated to the external threaded portion of the ground anchor.

7. The post anchoring support device of claim 6 further comprising a second hole on the horizontal plate dimensioned to accommodate the shaft, a circumferential platform on the upper portion of the shaft below the externally threaded portion for abutting a bottom surface of the horizontal plate about the second hole, and a nut complementary to the externally threaded portion for engaging an upper surface of the horizontal plate about the second hole and securing the horizontal plate against the circumferential platform.

8. The post anchoring support device of claim 7 wherein the support portion comprises a first and second horizontal platforms and a recessed platform in between the first and second horizontal platforms, the recessed platform defining a third hole dimensioned to accommodate the shaft, and the internally threaded portion is connected to the recessed platform coaxially with the third hole, wherein the recessed platform is positioned below the first and second horizontal platforms by a distance sufficient to provide clearance between the upper end of the shaft and first and second horizontal platforms when the internally threaded portion of the post receiving bracket is mated to the external threaded portion of the ground anchor.

9. A post anchoring support device for anchoring an end of a support post of a deck or similar construction to the ground, the post anchoring support device comprising:

a ground anchor having a shaft with a lower portion and an upper portion, the upper portion having an externally threaded portion and terminating in an upper end, the lower portion having a pointed lower end for facilitating insertion into the ground as the ground anchor is driven into the ground; and a post receiving bracket having a base with a vertically oriented internally threaded portion adapted to receive the externally threaded portion of the shaft, a support portion defining a support surface for abutting the end of the post, the support surface being located vertically on the receiving bracket to be above the upper end of the shaft when the internally threaded portion is mated to the external threaded portion, at least two vertical planar walls extending above the support surface, each planar wall having an inside surface for abutting a vertical side of the post and an outside surface, and each planar wall defining a plurality of vertically oriented elongate holes and having a raised portion on the outside surface adjacent each elongate hole adapted to abut a lower surface of a head of a fastener passing through the elongate hole and into the post to allow the fastener to travel within the elongate hole upon the application of a vertically force to the post anchoring support device sufficient to overcome a coefficient of friction between the head of the fastener and the raised portion.

10. The post anchoring support device of claim 9 wherein each raised portion comprises a narrow edge portion of highest elevation adjacent the elongate hole for abutting the lower surface of the head of the fastener, and tapers in elevation away from the elongate hole.

* * * * *